United States Patent [19]

Koza et al.

[11] Patent Number: 4,725,079

[45] Date of Patent: Feb. 16, 1988

[54] LOTTERY TICKET INTEGRITY NUMBER

[75] Inventors: John R. Koza, Atlanta, Ga.; Martin A. Keane, Arlington Heights, Ill.; William F. Behm, Marietta, Ga.

[73] Assignee: Scientific Games, Inc., Norcross, Ga.

[21] Appl. No.: 884,535

[22] Filed: Jul. 11, 1986

[51] Int. Cl.[4] ..... B42D 15/00

[52] U.S. Cl. ..... 283/73; 273/139; 283/70; 283/903

[58] Field of Search ..... 283/73, 70, 902, 903, 283/81; 273/139

[56] References Cited

U.S. PATENT DOCUMENTS

| | | | |
|---|---|---|---|
| 3,351,005 | 11/1967 | Giori | 283/903 X |
| 3,556,563 | 1/1971 | Scheinberg et al. | 283/73 X |
| 3,900,219 | 8/1975 | D'Amato et al. | 283/903 |
| 4,033,611 | 7/1977 | Johnsen | 283/903 |
| 4,099,721 | 7/1978 | Logander | 283/903 |
| 4,174,857 | 11/1979 | Koza | 283/903 |
| 4,241,942 | 12/1980 | Bachman | 283/903 |
| 4,398,708 | 8/1983 | Goldman et al. | 283/903 X |
| 4,585,254 | 4/1986 | Adams | 283/81 |
| 4,591,190 | 5/1986 | Clark | 283/903 |

*Primary Examiner*—Paul A. Bell

*Attorney, Agent, or Firm*—Jenner & Block

[57] ABSTRACT

A method for enhancing the security of instant lottery tickets. A book number indicating from which packet a particular lottery ticket originated is printed on the back of the ticket and an integrity number is printed on the front of the ticket. The integrity number is related to the book number by an algorithm known only to the ticket manufacturer and the lottery administration. To further enhance the security of the ticket, the book number and integrity number are simultaneously printed onto the ticket.

8 Claims, 4 Drawing Figures

FIG. 1
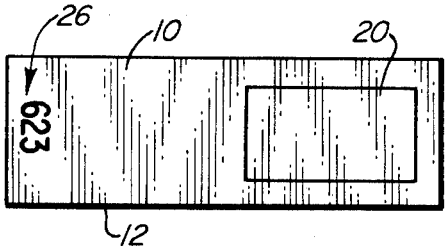
FIG. 2
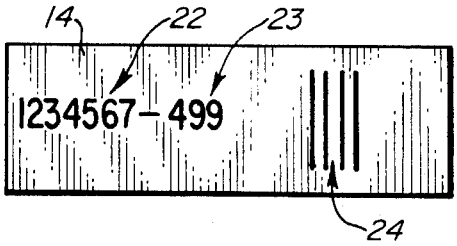
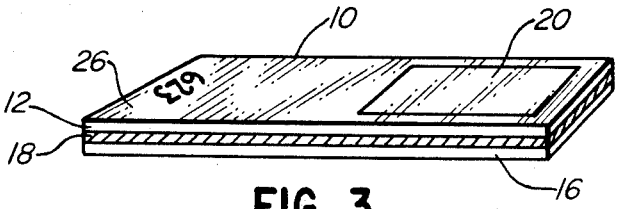
FIG. 3
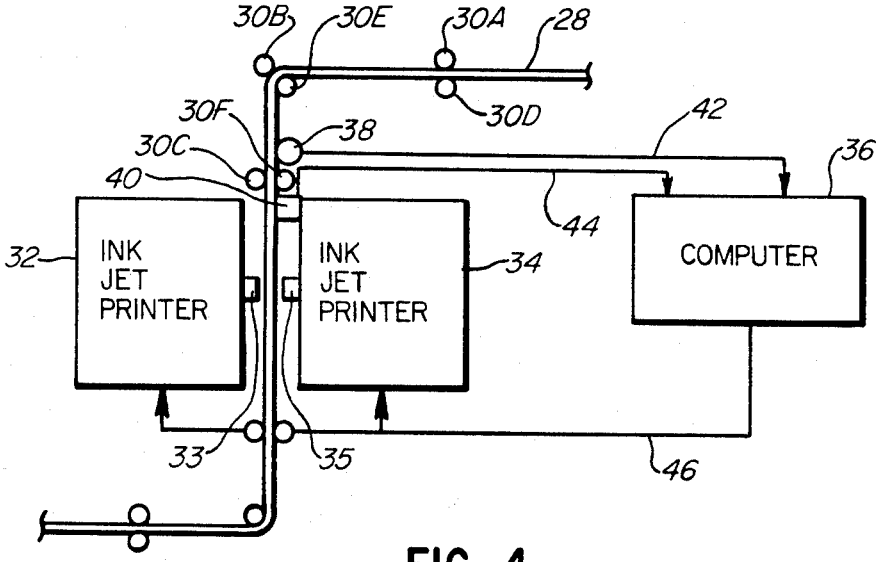
FIG. 4

LOTTERY TICKET INTEGRITY NUMBER

FIELD OF THE INVENTION

The invention relates to the field of lottery ticket security and, in particular, to a method utilizing information printed on the back of a lottery ticket to increase security.

BACKGROUND OF THE INVENTION

In most instant lotteries, the tickets are composed of a paper portion upon which foil, usually aluminum, is laminated. The winning numbers or symbols along with a validation number are printed on the foil on the front of the ticket and covered with a scratchoff material, typically a latex compound. Lottery tickets are normally printed in groups of 200 to 500, termed "books" or "packets," with consecutive book numbers printed on the back of the ticket. The book number is used by lottery administration for inventory control purposes.

This construction results in potential security problems for lottery administrations. For example, it might be possible for a dishonest lottery employee or others with access to winning tickets that have been received by the lottery as winners prior to the recordation of the validation number to remove the ticket from the lottery's office, delaminate the ticket and glue the foil with the winning symbols to a new paper portion. It is normal practice to have a validation number printed on the front of a lottery ticket which is not related to the book number. Once the foil with winning symbols has been affixed to a new paper portion, the ticket can then be resubmitted to the lottery with the name and address of another person written on the back of the ticket. In this manner, the winning ticket can be submitted to a lottery administration with the result that payment is made to the wrong party.

Similarly, the lottery ticket manufacturers are vulnerable to situations where someone takes a scrap ticket that has winning symbols, but does not have a book number printed on the back, and relaminate the ticket with a back from a losing ticket having a book number legitimately purchased from a retailer. Since the relaminated ticket will have a validation number and a book number, it will likely be paid as a winner by the lottery administration.

SUMMARY OF THE INVENTION

It is, therefore, an object of the invention to enhance the security of instant lottery tickets by printing on the front of the ticket an integrity number which is functionally related to the book number printed on the back of the ticket.

It is an additional object of the invention to provide an apparatus for applying identifying information on both sides of a lottery ticket simultaneously.

BRIEF DESCRIPTION OF THE DRAWINGS

FIG. 1 is a plan view of the front of a lottery ticket;

FIG. 2 is a plan view of the back of a lottery ticket;

FIG. 3 is a perspective view of a lottery ticket; and

FIG. 4 is a block diagram of an apparatus for printing integrity numbers and book numbers simultaneously.

DETAILED DESCRIPTION OF THE INVENTION

Provided in FIG. 1 is a view of the front 10 of an instant lottery ticket which is normally printed on aluminum foil 12. A view of the back 14 of the ticket is provided in FIG. 2. The back 14 of a lottery ticket is typically printed on a member 16 composed of paper stock.

In FIG. 3, is illustrated the structure of an instant lottery ticket with the aluminum foil 12 having the front 10 of the ticket printed on it bonded by means of an adhesive 18 to the bottom 16 of the ticket. Covering the symbols (not shown) that indicate whether or not the ticket is a winner is a latex covering 20 that can be scratched off by the owner of the ticket.

Printed on the back surface 14 of the ticket as shown in FIG. 2 is a "book number" 22 which identifies the packet or group of tickets to which the ticket belongs. Normally, instant lottery tickets are printed in books or packets of 200 to 500, and the number of the book or packet is printed on the back of each ticket for accounting purposes. Along with the book number 22, the number 23 of the ticket in the book is printed. Also printed on the back of the ticket are lines, indicated at 24, for the individual who is submitting a winning ticket to write his name, address, and telephone number as well as a line on which to sign the ticket.

In the preferred embodiment of the invention, the book number 22 is converted by means of a predetermined algorithm to an integrity number, indicated at 26, which is printed on the front 10 of the ticket. The integrity number 26 can take the form of a check sum of the book number 22. In the preferred embodiment of the invention, the integrity number 26 will be a three-digit, alpha-numeric number. It should be noted that the term "number" as used herein includes alpha characters or even other symbols, if appropriate.

Thus, a three-digit integrity number which is composed of digits that can have one of 34 characters (24 alpha and 10 numbers) will have over 39,000 possible combinations. It is, therefore, unlikely that a person laminating the back 16 to the front or foil portion 12 of a winning ticket would find one with a book number 22 that would convert to the integrity number 26 printed on the foil. In this manner, the likelihood of fraudulently relaminated tickets being paid by a lottery administration is reduced.

A number of different algorithms can be used to convert the book number 22 to the integrity number 26. For example, the book number can be converted to a base 34 number and then the standard DES encryption algorithm can be used to convert the base 34 number to the integrity number 26. Alternatively, a conventional randomizing algorithm or even a simple mapping algorithm could be used. Along with the book number 22 the ticket number 23 could be used in the encryption algorithm to add further security to the integrity number 26. In general, the more characters in the integrity number 26 and the more elements used to create it, the greater will be the resulting security.

In FIG. 4 is illustrated in block diagram form an apparatus for applying integrity numbers 26 to lottery tickets. Lottery tickets are usually produced in printing operations that have a number of print stations. A portion of a lottery ticket printing operation is shown in FIG. 4 that presents the preferred method for printing the integrity number 26 on the ticket. A ticket stock web 28 is guided by rollers 30 A-F past two opposedly aligned ink jet printers 32 and 34 having nozzles 33 and 35, respectively.

A computer 36 receives inputs from a web speed sensor 38 and an optical position sensor 40 over lines 42 and 44, respectively, that indicate the speed and position of individual tickets in the web 28. The computer 36 then generates print control signals on line 46 that cause the ink jet printers 32 and 34 to substantially, simultaneously print the book number 22 and the integrity number 26 on each ticket. By simultaneously printing both book number 22 and integrity number 26 from opposedly aligned printers 32 and 34 as shown in FIG. 4, effective application of the numbers on each side of the ticket can be achieved. Alternatively, a single ink jet printer such as 32 having multiple nozzles can be used wherein the nozzles are opposedly aligned in the manner shown by nozzles 33 and 35 in FIG. 4.

It should also be understood that a more basic form of enhanced security can be achieved by utilizing the apparatus of FIG. 4 to print the book number 26 on both sides of the ticket.

We claim:

1. In a lottery ticket having a first member laminated to a second member, winning indicia printed on one of said members, space provided on one of said members to write winner information, and accounting information printed on said first member; the improvement comprising:

an integrity number, algorithmicly related to at least a portion of said accounting information, printed on said second member.

2. The ticket of claim 1 wherein said integrity number has fewer characters than said portion of accounting information.

3. The ticket of claim 2 wherein said integrity number is a check sum of said portion of accounting information.

4. The ticket of claim 1 wherein said portion of accounting information is a book number.

5. The ticket of claim 4 wherein said integrity number has fewer characters than said book number.

6. The ticket of claim 4 wherein said integrity number is a check sum of said book number.

7. The ticket of claim 1 wherein said winning indicia is printed on said second member, said accounting information includes a book number and said integrity number is algorithmicly related to said book number.

8. The ticket of claim 7 wherein said integrity number has fewer characters than said book number.

* * * * *